US005235873A

United States Patent [19]

Tengan

[11] Patent Number: 5,235,873

[45] Date of Patent: Aug. 17, 1993

[54] BACKLASH ELIMINATOR

[75] Inventor: Alfred K. Tengan, Huntington Beach, Calif.

[73] Assignee: Hydraulic Units, Incorporated, Duarte, Calif.

[21] Appl. No.: 755,517

[22] Filed: Aug. 29, 1991

[51] Int. Cl.[5] ..... G05G 3/00

[52] U.S. Cl. ..... 74/582

[58] Field of Search ..... 74/582

[56] References Cited

U.S. PATENT DOCUMENTS

| | | | |
|---|---|---|---|
| 142,611 | 9/1873 | Carothers | 74/582 |
| 1,659,270 | 2/1928 | Knowles | 74/582 |
| 2,461,633 | 2/1949 | Dorey | 74/582 |
| 2,912,564 | 11/1959 | Deffenbaugh | 219/89 |
| 3,022,060 | 2/1962 | Cook et al. | 74/582 |
| 3,120,951 | 2/1964 | Finch | 74/582 |
| 3,841,468 | 10/1974 | Eggert | 74/582 |
| 4,569,243 | 2/1986 | Chapman et al. | 74/582 X |

FOREIGN PATENT DOCUMENTS

| | | | |
|---|---|---|---|
| 210393 | 7/1940 | Switzerland | 74/582 |

*Primary Examiner*—Rodney H. Bonck
*Assistant Examiner*—Ryan W. Massey
*Attorney, Agent, or Firm*—Poms, Smith, Lande & Rose

[57] ABSTRACT

A backlash eliminating device is provided in which two members are biased outwardly in opposite directions in an opening in a housing. Rotatable members with arcuate outer surfaces are connected through self-aligning bearings to these members and can rotate about transverse axes. The end of a crank arm at either end of the unit has an arcuate surface that engages the arcuate surface of one of the rotatable members. Self-aligning bearings, rotatable about axes transverse to the housing, connect the crank arm ends to the housing. The biasing force eliminates clearance at the bearings and the self-aligning bearings allow the crank arms to be slightly cocked without resulting in malfunction.

22 Claims, 3 Drawing Sheets

BACKLASH ELIMINATOR

BACKGROUND OF THE INVENTION

In certain mechanisms, lost motion can result in severe problems and performance penalties. An example is in an aircraft control system where typically a cable arrangement, actuated by the pilot, causes movement of certain links and levers to move an aircraft control surface. Aerodynamic forces on the control surface can result in severe vibrations in the mechanism when lost motion is present. In the absence of a backlash eliminating device, nothing in the system can resist oscillations which operate through the clearance present in the mechanism.

Backlash also can be a problem in various kinds of linkages and mechanisms other than aircraft controls, where precise movement is necessary, particularly movement in two directions.

A problem can arise with a backlash elimination device from misalignment of the input and output forces applied to it. Generally speaking, it is impossible to build a system in which the forces on a link are exerted in a plane that precisely includes the longitudinal axis of the link. Some lateral forces are inevitable. Such lateral forces applied to a backlash eliminating device can result in binding of the moving components and malfunctioning of the device.

SUMMARY OF THE INVENTION

The present invention provides an improved backlash eliminator which effectively takes out clearance in a linkage while at the same time compensating for misalignment of the forces applied to it from either end.

The backlash eliminator of this invention may act as a pushrod which eliminates lost motion between two separately mounted crank arms. The backlash eliminator may include a housing having in its central portion a compression spring biasing two slides outwardly in opposite directions along a rectilinear path. Each slide has a clevis at its outer end through which extends a transverse pin mounting a ball bearing. An annular member that acts as a tire circumscribes the outer race of the bearing. The tire has a cylindrical outer surface which engages a similarly formed surface on the end of one of the rotatable cranks. The crank end is rotatable about the axis of another ball bearing mounted on a transverse pin which extends through the wall of the housing. Both ends of the backlash eliminator are of the same operative construction. The compression spring, acting through the slides and the other components, takes out all of the clearance at the bearings and the connections of the various moving parts, so that there is no backlash, (i.e., lost motion) between the ends of the two cranks that extend into the backlash eliminator.

All four ball bearings are of the self-aligning type, which enables the backlash eliminator to function properly irrespective of the inevitable misalignment between the two cranks that connect to the ends of the device. The cranks cannot be mounted such that they provide forces that react against the backlash eliminator precisely within a single plane. Some lateral force component will be generated. Because all of the four ball bearings employed in the device are of the self-aligning type, the components can take a slight offset with respect to each other as a result of the misaligned forces, while still maintaining correct interengagement and without binding. The cylindrical surface of the tire at either end of the device, for example, will make line contact with the cylindrical surface on the end of the crank which it engages, even if the crank arm is cocked slightly relative to the backlash eliminator. These mating parts can rotate freely irrespective of the misaligned forces applied to the backlash eliminator.

DETAILED DESCRIPTION OF THE INVENTION

Figure 1:
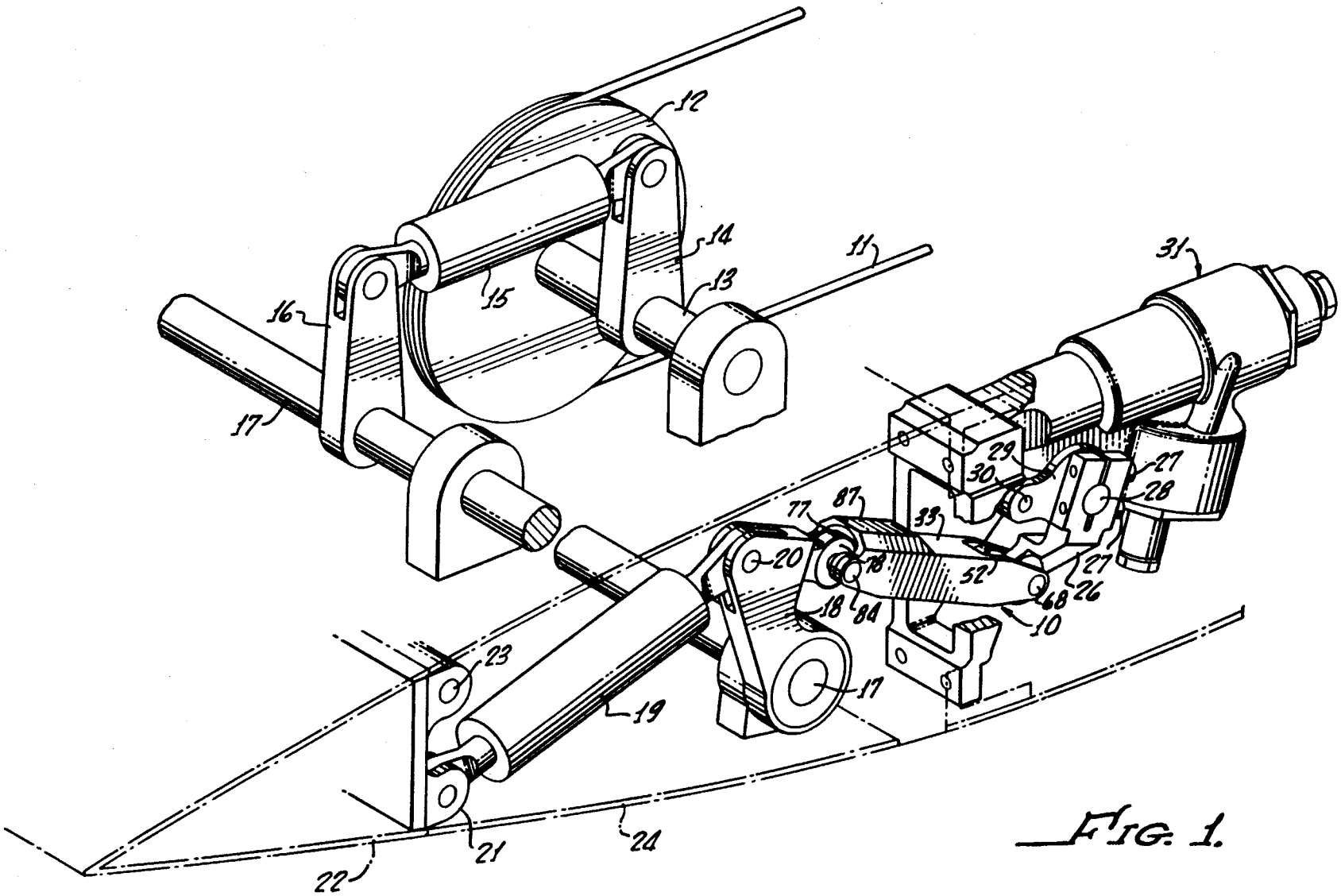
FIG. 1 is a perspective view of an aircraft control system making use of the backlash eliminator of this invention.

The backlash eliminator 10 of this invention is illustrated as part of an aircraft control system in FIG. 1. In this system, a cable 11 from the pilot's compartment rotates a pulley 12 so that the pulley turns a shaft 13 and with it an arm 14 mounted on the shaft. The arm 14, through a link 15, drives an arm 16 that in turn rotates a shaft 17. A crank arm 18 is rotated by the shaft 17 and engages a link 19 one end of which connects to the crank arm 18 at a pin 20. The opposite end of the link 19 connects to a bracket 21. The latter element is mounted on a control tab 22, rotatable about a shaft 23. Aerodynamic forces on the tab 22 result in movement of an elevator 24 of the aircraft, to which the tab is connected.

The crank arm 18 also connects to one end of the backlash eliminator 10, as will be described below. The opposite end of the backlash eliminator 10 connects to a crank arm 26 which at its outer end is split and is clamped by screws 27 onto a pin 28 carried by a lever 29. The crank arm 26 and lever 29 act as a unit to rotate a shaft 30 that is part of a vibration damper 31.

Consequently, movement of the tab 22 in either direction is resisted by the vibration damper 31 so that unwanted oscillations can be damped. The backlash eliminator 10 eliminates lost motion between the crank arm 18 that drives the tab 22 and the crank arm 26 that connects to the vibration damper 31. Otherwise, clearances would be present which could not be compensated for by the vibration damper and undesired vibration would occur in the linkage.

Figures 2, 6:
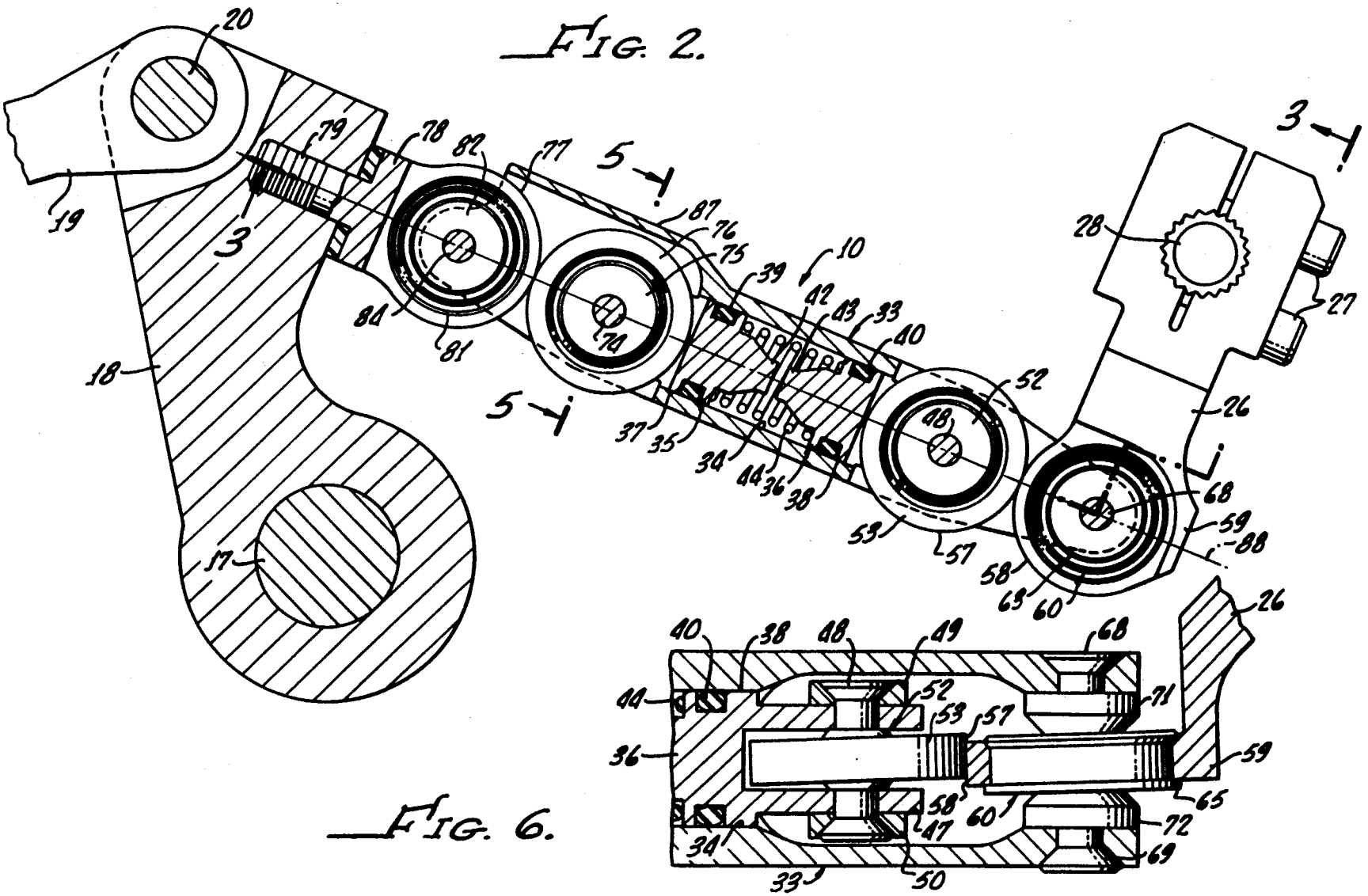
FIG. 2 is an enlarged longitudinal sectional view of the portion of the system that includes the backlash eliminator.
FIG. 6 is an enlarged fragmentary longitudinal sectional view illustrating the effect of misaligned forces applied to the backlash eliminator.
Figure 3:
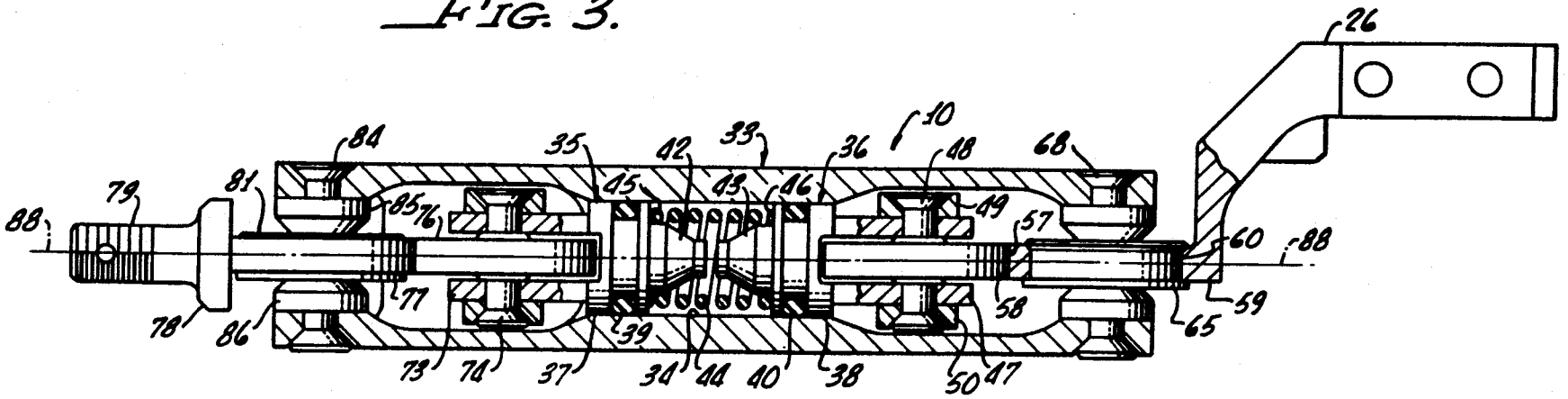
FIG. 3 is a longitudinal sectional view taken along line 3—3 of FIG. 2.

The backlash eliminator 10 includes a housing 33 which supports the other components and has an internal cylindrical surface 34 at its central portion (FIGS. 2 and 3). Within the surface 34 are two opposed slides 35 and 36 which have cylindrical sections 37 and 38, respectively, that complementarily engage the wall 34 of the housing. The slides 35 and 36, therefore, can move in the path defined by the cylindrical surface 34 of the housing 33. The cylindrical sections 37 and 38 are provided with annular grooves that receive O-rings 39 and 40, respectively, which seal moisture from the area within the housing between the two slides.

At their inner ends the slides 35 and 36 are provided with extensions 42 and 43 of reduced dimension. A compression spring 44 fits over the extensions 42 and 43 and bears against the inner radial walls 45 and 46 of the slides to bias them apart in the cylindrical passageway 34. The extensions 42 and 43 act as stops that limit travel of the slides 35 and 36 toward each other to prevent overstressing the spring 44 during assembly. The possibility of corrosion of the spring is minimized by the seals 39 and 40.

Figure 4:
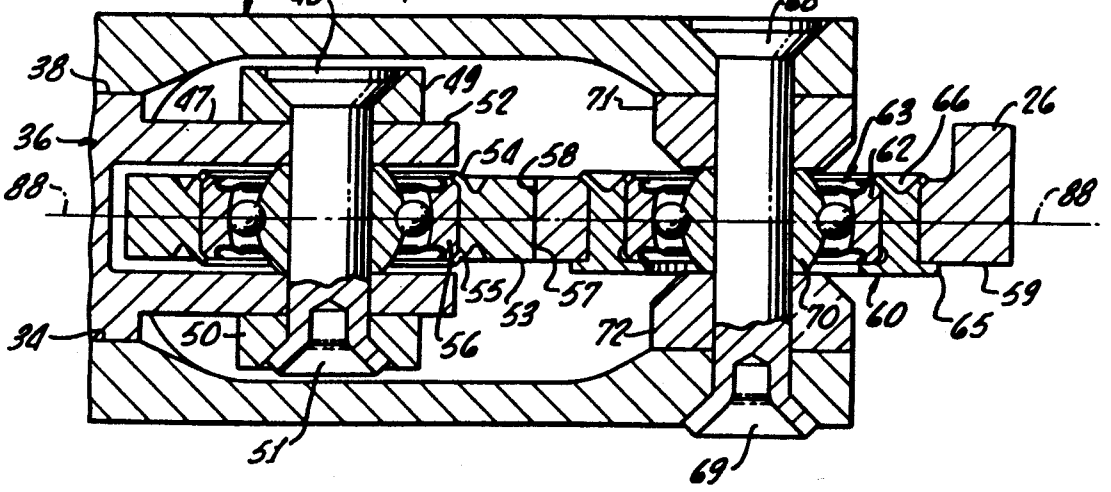
FIG. 4 is an enlarged fragmentary longitudinal sectional view that includes one end portion of the backlash eliminator.
Figure 5:
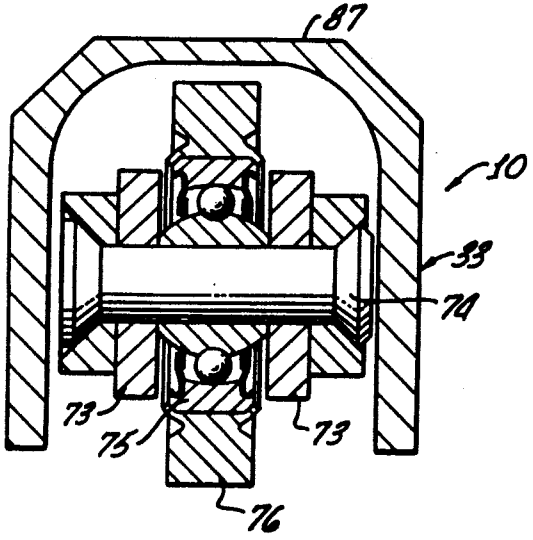
FIG. 5 is an enlarged transverse sectional view taken along line 5—5 of FIG. 2.

At its outer end the slide 35 defines a clevis 47. As seen in the enlarged view of FIG. 4, a transverse pin 48 extends through the clevis 47, bearing against washers 49 and 50 on the outside of the clevis. A head is at one end of the pin 48, while a recess 51 is formed in the opposite end so that it can be flared over the washer 50. Mounted on the pin 48 within the clevis 47 is a self-aligning ball bearing 52. Circumscribing the bearing 52 is an annular member 53 that also extends within the clevis 47. The member 53 is provided with flanges 54 and 55 along its inner periphery which are bent over the edges of the outer race 56 of the bearing 52. This holds the annular member 53 to the outer race 56 of the bearing.

The outer circumferential surface 57, which is shaped as a right cylinder, makes line contact with a surface 58 that is a segment of a right cylinder formed on the outer end 59 of the crank arm 26. Therefore, the annular member 53 acts as a tire around the bearing 52 to engage the crank arm end 59. A sleeve 60 holds the crank arm end 59 to the outer race 62 of a self-aligning ball bearing 63. The sleeve 60 includes a flange 65 at one end which overlaps the outer bearing race 62 and the crank arm end 59. An annular groove 66 extends into the opposite end of the sleeve 60. That end of the sleeve 60 is bent over the outer bearing race 62 and the crank arm end 59 to provide an upset cooperating with the flange 65 to hold the crank arm to the bearing 63.

A pin 68, upset at one end 69, extends transversely through the housing 33 and is parallel to the pin 48, thus being perpendicular to the axis of the cylindrical opening 34. The pin 68 extends through the inner race 70 of the self-aligning ball bearing 63. Washers 71 and 72 fit between the wall of the housing and the opposite ends of the inner race 70, preventing axial movement of the bearing 63.

The operative components at the opposite end portion of the backlash eliminator 10 are identical to those just described. The clevis 73 of the slide 35 receives a pin 74 that extends transversely through it and through the inner race of a self-aligning ball bearing 75. The outer race of the bearing 75 is circumscribed by an annular member 76 which forms a tire that engages a surface 77, which is a cylindrical segment formed on a bracket 78. The latter member, as best seen in FIG. 2, has a threaded shank 79 which connects it to the outer end portion of the crank arm 18. The bracket 78, therefore, forms an extension of the crank arm 18 acting the same as if it were an integral part of the crank arm.

The bracket 78 includes a circular opening concentric with the cylindrical surface 77. This opening receives an annular member in the form of a sleeve 81 that is identical to the sleeve 60. Thus, the sleeve 81 connects the bracket 78 to the outer race of a self-aligning ball bearing 82. The inner race of the bearing 82 receives a pin 84 that extends transversely through the housing 33. Washers 85 and 86 are interposed between the wall of the housing 33 and the opposite ends of the inner race of the bearing 82.

The housing 33 may include a protective shield 87 on one side at this end of the unit 10.

Because the crank arm ends 59 and 77 are fixed longitudinally of the housing 33 by virtue of their connections to the pins 68 and 84, the slides 35 and 36 are limited in their outward positions by the engagement of the annular members 53 and 76 with the crank arm ends. The parts are proportioned so that this causes the spring 44 to be compressed and exert an outward longitudinal force on the slides 35 and 36. The annular members 53 and 76 protect the outer races of the bearings 52 and 75, which would not withstand direct application of the forces from the crank arm ends 59 and 77.

In this arrangement, the longitudinal axis of the cylindrical opening 34 in the housing 33, and an extension of this axis indicated by the line 88, intersects the axes of the pins 48 and 68, which are the axes of rotation of the annular member 53 and the end 59 of the crank arm 26 respectively. The line 88 also intersects the axes of pins 74 and 84 at the opposite end of the backlash eliminator. The line of contact between the members 53 and 59, and the line of contact between the members 76 and 78 additionally are bisected by the line 88. The force of the spring 44, through the slides 35 and 36, is exerted in the direction of the axis of the opening 34 and maintains these surfaces in interengagement.

As the crank arm 26 rotates about the shaft 31, in response to a force transmitted through the backlash eliminator 10, its end 59 can rotate about the axis of the transverse pin 68 as permitted by the bearing 63. This rotation of the crank arm end 59 rotates the annular member 53 about the axis of the pin 49. The rotation of the crank arm 18 about the shaft 17 acts similarly at the opposite end of the backlash eliminator 10, rotating the bracket 78 at the bearing 82 and causing rotation of the annular member 76 around the bearing 75.

Lost motion between the crank arm 18 and the crank arm 26 is eliminated by the force of the spring 44 acting through the other components of the device to take out all clearance in the longitudinal direction. The spring force on the slide 36 is transmitted through the pin 48 to the bearing 52 and the annular member 53 around that bearing. The force is transmitted also to the end 59 of the crank arm 26, through the sleeve 60 and the bearing 63 to the pin 68 and into the housing 33. Because of this force, all clearance is taken out at the bearings 52 and 63. There is a similar and opposite transmission of forces at the opposite end of the unit. The spring force acting through the slide 35 eliminates lost motion through the bearings 75 and 82 and the elements associated with them. Therefore, backlash is eliminated between the crank arms 18 and 26. The force exerted by the spring 44 because of its compression is greater than the external load applied to the backlash eliminator 10 during operation of the aircraft control system so that clearances cannot open up to create lost motion within the unit 10.

An important advantage of the backlash eliminator of this invention is its ability to compensate for misalignment of the two crank arms without loss of function. This comes about through use of the self-aligning bearings 52, 63, 75 and 82. In practice it is impossible to avoid some misalignment between the crank arms 18 and 26. That is to say, the direction of the forces applied by the crank arms 18 and 26 against the backlash eliminator cannot be precisely within a plane that includes the longitudinal axis of the backlash eliminator. Manufacturing tolerances will not permit this. Some lateral force, although slight, is inevitable. If it were not for the self-aligning bearings, this misalignment of the force vectors could cause binding and prevent proper functioning of the backlash eliminator. However, because of the self-aligning bearings, the parts may shift small amounts relative to each other without affecting the free movement of the rotating parts.

This effect is shown, greatly exaggerated, in FIG. 6. As illustrated, the crank arm 26 is misaligned relative to the longitudinal axis of the backlash eliminator 10. This causes the sleeve 60 to shift the outer race 62 of the bearing 63 rotationally relative to the inner race 70, which retains its original position. The force of the surface 58 of the crank end 59 on the surface 57 of the tire 53 causes a similar shifting of the latter member. This is permitted by the self-aligning bearing 52. Therefore, the axes of rotation of the crank end 59 and of the tire 53 tilt slightly relative to the longitudinal axis of the housing 33 along which the slides 34 and 35 are guided. This enables the cylindrical surfaces 57 and 58 to meet with line contact and to be held firmly in interengagement by the compression spring 44. There is no binding or loss of function.

The foregoing detailed description is to be clearly understood as given by way of illustration and example only, the spirit and scope of this invention being limited solely by the appended claims.

What is claimed is:

1. A device for eliminating lost motion comprising a duality of opposed first members, guide means defining a rectilinear path, said first members engaging said guide means and being movable in said path, resilient means biasing said first members apart along said path, a duality of second members, each of said second members including a surface defining at last a segment of a circle, means for rotatably connecting one of said second members to one of said first members and the other of said second members to the other of said first members, a duality of third members each of which is rotatable about a location remote from said guide means, each of said third members having a portion with a surface defining at least a segment of a circle, said surface of one of said third members engaging said surface of one of said second members and said surface of the other of said third members engaging said surface of the other of said second members, said second and third members and said resilient means being arranged such that said surface of each of said second members is urged toward said surface of said third member which it engages, and means for connecting each of said third members to said guide means so that said third members can rotate relative to said guide means, whereby rotation of said third members relative to said guide means causes rotation of said second members relative to said first members because of said engagement of said surfaces of said third members with said surfaces of said second members, and said resilient means removes lost motion between said third members.

2. A device for eliminating lost motion comprising support means defining a straight path, first and second movable members engaging said support means for movement in said path, resilient means biasing said movable members apart, a duality of first rotatable members, means for connecting one of said first rotatable members to one of said movable members and the other of said first rotatable members to the other of said movable members so that each of said first rotatable members can rotate about an axis perpendicular to said path, each of said first rotatable members having an outer peripheral surface at least in part circular in cross section and coaxial with said axis about which the first rotatable member rotates, a duality of second rotatable members, and means for connecting each of said second rotatable members to said support means for rotation about an axis perpendicular to said path, each of said second rotatable members having an outer peripheral surface which in cross section defines at least a segment of a circle which is coaxial with said axis of rotation of the second rotatable member, said surface of one of said first rotatable members making line contact with said surface of one of said second rotatable members, and said surface of the other of said first rotatable members making line contact with said surface of the other of said second rotatable members, an extension of the longitudinal axis of said path intersecting said rotational axes of said first and said second rotatable members and intersecting said lines of contact between said first and said second rotatable members.

3. A device as recited in claim 2 in which said means for connecting said first rotatable members to said movable members, and said means for connecting said second rotatable members to said support means, include means for permitting said axes of rotation of said first and second rotatable members to tilt relative to said path.

4. A device as recited in claim 2 in which said means for connecting each of said first rotatable members to said movable members, and said means for connecting each of said second movable members to said support means, includes a self-aligning ball bearing, whereby said axes of rotation of said first and second rotatable members can tilt relative to said path.

5. A device as recited in claim 2 in which said support means comprises a housing having a cylindrical surface the longitudinal axis of which defines said path, said movable members including portions engaging said cylindrical surface so as to be guided thereby along said path.

6. A device as recited in claim 2 in which said resilient means comprises a compression spring interposed between and engaging said movable members.

7. A device as recited in claim 2 in which each of said movable members includes an outwardly facing clevis, and said means for connecting each of said first rotatable members to one of said movable members includes a pin extending transversely through the clevis, and a bearing around said pin, each of said first rotatable members extending around one of said bearings.

8. A device as recited in claim 2 in which said means for connecting each of said second rotatable members to said support means includes an antifriction bearing, means connecting the inner race of said bearing to said support means, and means for connecting the outer race of said bearing to one of said second rotatable members.

9. A device as recited in claim 8 in which each of said second rotatable members includes an opening therein, and said means for connecting the outer race of said bearing to one of said second rotatable members includes an annular member received in said opening and receiving therein the outer race of one of said bearings, said annular member being connected both to the outer race which it receives and to the second rotatable member in which it is received.

10. A device as recited in claim 9 in which said annular member includes a flange means at either end thereof overlapping the outer race which it receives and the second rotatable member in which it is received for making said connection.

11. A device as recited in claim 10 in which one of said flange means is outwardly bent for so overlapping said outer race and said second rotatable member.

12. A device as recited in claim 2 in which each of said movable members includes an outwardly facing clevis, said means for connecting each of said first rotatable members to one of said movable members includes pin means transverse to said clevis and a bearing around said pin means, each of said first rotatable members extending around one of said bearings, each of said second rotatable members includes an opening therein, and said means for connecting each of said second rotatable members to said support means includes pin means carried by said support means, and a bearing received in said opening and positioned around said last mentioned pin means.

13. A device as recited in claim 12 in which said bearings are self-aligning antifriction bearings.

14. A device for eliminating lost motion in a system of movable members comprising a housing having an opening therethrough, a pair of slides in said housing movable longitudinally and guided by the wall of said opening, a compression spring between said slides and engaging each of said slides so as to bias said slides apart, the opposite end of each of said slides being bifurcated, a pair of first antifriction bearings, one of which is received in said bifurcated end of one of said slides, and the other of which is received in said bifurcated end of the other of said slides, a pair of first transverse pins, one connecting the inner race of one of said first antifriction bearings to one of said slides and the other connecting the inner race of the other of said first antifriction bearings to the other of said slides, a pair of annular members, one of which circumscribes the outer race of one of said first antifriction bearings and is rotatable therewith, and the other of which circumscribes the outer race of the other of said first antifriction bearings and is rotatable therewith, a duality of force transmitting members, one extending into one end of said housing, and the other extending into the other end of said housing, one of said force transmitting members having an arcuate surface engaging one of said annular members and having an opening therethrough, the other of said force transmitting members having an arcuate surface engaging the other of said annular members and having an opening therethrough, a duality of second antifriction bearings, one of said second antifriction bearings having an outer race received within said opening in one of said force transmitting members and rotatable with said one force transmitting member, the other of said second antifriction bearings having an outer race received within said opening in the other of said force transmitting members and rotatable with said other force transmitting member, and a duality of second transverse pins, one of which connects the inner race of one of said second antifriction bearings to said housing and the other of which connects the inner race of the other of said antifriction bearings to said housing, whereby an outward force is exerted by said compression spring on each of said force transmitting members and clearances are eliminated at said bearings.

15. A backlash elimination device for transmitting a force between two rotatable members comprising an elongated housing having an opening extending longitudinally therein, a compression spring in the central portion of said opening, first and second slide members received in said opening and slidable longitudinally thereof, one end of said spring engaging said first slide member and the opposite end of said spring engaging said second slide member for biasing said slide members toward opposite ends of said housing, each of said slide members having a bifurcated end remote from said spring, a duality of first pins, one of said first pins extending transversely through said bifurcated end of said first slide member, the other of said first pins extending transversely through said bifurcated end of said second slide member, a duality of first antifriction bearings, one of which is received in said bifurcated end of said first slide member and the other of which is received in said bifurcated end of said second slide member, the inner races of said first antifriction bearings being mounted on said first pins and fixed relative thereto, whereby the outer races of said first antifriction bearings are rotatable about said first pins, a duality of first annular members, one of which circumscribes and is secured to the outer race of one of said first antifriction bearings, the other of which circumscribes and is secured to the outer race of the other of said first antifriction bearings, said first annular members having outer circumferential surfaces at least a portion of which are segments of a right cylinder, a duality of second pins positioned one adjacent one end of said housing and the other adjacent the opposite end of said housing, said second pins being parallel to said first pins and transverse relative to said opening, a duality of second antifriction bearings, one of which has an inner race receiving one of said second pins and secured thereto, the other of which has an inner race receiving the other of said second pins and being secured thereto, a duality of second annular members, one of said second annular members circumscribing the outer race of one of said second antifriction bearings and being secured thereto, the other of said second annular members circumscribing the outer race of the other of said second antifriction bearings and being secured thereto, and first and second rotatable force transmitting members each having an end portion having an opening therethrough and received in one end of said housing, one of said second annular members being received in said opening in said first force transmitting member and being secured to said first force transmitting member, the other of said second annular members being received in said opening in said second force transmitting member and being secured to said second force transmitting member, said end portions of said first and second force transmitting members having outer surfaces at least portions of which are the segments of a right cylinder, said portion of said outer surface of said first force transmitting member engaging said surface of one of said first annular members and said portion of said outer surface of said second force transmitting member engaging said surface of the other of said first annular members, said compression spring by so biasing said slide members toward opposite ends of said housing causing said surfaces of said first annular members to be biased against said portions of said outer surfaces of said first and second forced transmitting members, whereby said first force transmitting member can rotate relative to said second force transmitting member and said compression spring eliminates lost motion therebetween.

16. A device as recited in claim 15 including in addition seal means interposed between each of said slide members and the wall of said opening outwardly of said compression spring for preventing entry of moisture into said opening in said housing in the vicinity of said spring.

17. A device as recited in claim 16 in which said seal means are O-rings.

18. A device as recited in claim 15 in which said first and second antifriction bearings are self-aligning.

19. A device as recited in claim 15 in which said first annular members include inner circumferential edge portions upset over said outer races of said first anti friction bearings for thereby securing said first annular members to said first antifriction bearings.

20. A device as recited in claim 15 in which said second annular members include inner edge portions upset over said outer races of said second antifriction bearings and outer circumferential edge portions upset over said first and second force transmitting members, whereby said second annular members are secured to said outer races of said second antifriction bearings and to said first and second force transmitting members.

21. A device as recited in claim 15 in which said slides include stop surfaces adjacent each other for limiting the movement of said slides toward each other so as to prevent overstressing said compression spring.

22. A device as recited in claim 15 in which said first and second force transmitting members are rotatable crank arms, said crank arms being rotatable in approximately but not exactly the same plane whereby some torque load is imposed upon said backlash eliminating device upon rotation of said crank arms which is compensated for by said self-aligning bearings.

* * * * *